United States Patent [19]

Vann

[11] 4,334,580

[45] Jun. 15, 1982

[54] CONTINUOUS BOREHOLE FORMED HORIZONTALLY THROUGH A HYDROCARBON PRODUCING FORMATION

[75] Inventor: Roy R. Vann, Houston, Tex.

[73] Assignee: Geo Vann, Inc., Houston, Tex.

[21] Appl. No.: 132,765

[22] Filed: Mar. 24, 1980

[51] Int. Cl.[3] ..... E21B 7/04; E21B 43/24; E21B 43/117; E21B 43/119

[52] U.S. Cl. ..... 166/268; 166/50; 166/272; 166/297; 175/4.51; 175/4.6; 175/62

[58] Field of Search ..... 166/50, 52, 268, 272, 166/297, 314; 175/61, 62, 53, 75, 4.51, 4.6; 405/184

[56] References Cited

U.S. PATENT DOCUMENTS

| | | | |
|---|---|---|---|
| 2,349,033 | 5/1944 | Elliott | 175/62 X |
| 3,451,491 | 6/1969 | Clelland | 405/184 X |
| 3,986,557 | 10/1976 | Striegler et al. | 166/50 X |
| 4,043,136 | 8/1977 | Cherrington | 175/62 X |
| 4,117,895 | 10/1978 | Ward | 45/184 X |

*Primary Examiner*—Stephen J. Novosad
*Attorney, Agent, or Firm*—Marcus L. Bates

[57] ABSTRACT

A borehole is formed down into the ground and extends towards an underlying pay zone, and then is turned horizontally through the pay zone, and then continues back up towards the surface of the earth; so that the resultant borehole is continuous from an inlet to an outlet, with the inlet and outlet being spaced from one another. When the free end of the drill string arrives at the outlet, one end of a casing string is attached thereto, and the casing string is pulled back through the entire borehole so that the borehole is cased from the outlet to the inlet, or vice versa. The casing is perforated adjacent to the pay zone so that the hydrocarbons may flow from the pay zone into the interior of the casing. Production is achieved through either of the spaced inlet or outlet; or, by using one vertical length of the borehole to force fluid to flow through the entire borehole, thereby forcing the production to the surface.

7 Claims, 9 Drawing Figures

CONTINUOUS BOREHOLE FORMED HORIZONTALLY THROUGH A HYDROCARBON PRODUCING FORMATION

RELATED PATENT APPLICATION

U.S. Pat. No. 4,194,577 filed Oct. 17, 1977 issued Mar. 25, 1980, entitled: "Method and Apparatus For Completing a Slanted Borehole".

BACKGROUND OF THE INVENTION

There are many areas in the world where hydrocarbon containing formations are disposed relatively near the surface of the earth; however, these formations are relatively thin, and therefore, when penetrated by a borehole, only a small area of the borehole is adjacent to the hydrocarbon containing formation. Consequently, the production rate often is not economical. Moreover, many of these formations are in highly unconsolidated zones, thereby causing considerable sand or other undesirable material to be produced along with the hydrocarbons. Moreover, the hydrocarbons often are of a composition which is extremely viscous and therefore difficult to produce when using conventional production methods.

It is possible to drill a borehole down into the ground, turn the borehole horizontally through a pay zone, and then extend the borehole back up to the surface of the ground so that a continuous borehole extending from an inlet to an outlet is achieved. Wallace, et al U.S. Pat. No. 4,016,942; Striegler, et al U.S. Pat. No. 3,986,557; and Vann U.S. Pat. No. 4,194,577, each propose a method of directional drilling, and reference is made to these three patents as well as to the various art cited therein, for further background of this invention.

Striegler, et al completes his borehole, and thereafter, he somehow or another inserts a perforated casing throughout the entire drill string. The drill string is then withdrawn from the borehole, and it is stated that this action causes a perforated casing to be left downhole in the borehole so that steam can be forced into the inlet, with production occurring through the outlet.

Vann U.S. Pat. No. 4,194,577 drills a slanted borehole which extends horizontally through a pay zone, he then cases the borehole, and completes a very long horizontal length of the casing by perforating in a downward direction with special perforating apparatus.

In forming a borehole of 10,000 feet in length, for example, the drill bit usually is about eight inches in diameter, although it could be made larger if economics were of no consideration. During most drilling operations, it is necessary to continuously turn the bit while circulating a drilling fluid through the entire borehole annulus in order to prevent sticking the drill string. Should circulation be terminated while drilling in an unconsolidated zone, there is some likelihood that circulation would be lost and the drill string stuck thereby causing abandonment of the hole.

The interior of a four and one-half inch drill string having an eight inch bit on the end thereof is extremely small; for example, on the order of two to three inches inside diameter. It is obvious that a borehole formed in the usual manner by the employment of commercially available bits and drill strings would therefore necessarily employ an extremely small casing diameter if the teachings of the Striegler, et al patent were followed.

It would be desirable to be able to form a continuous borehole which extends from an inlet, through a pay zone, and then to an outlet; and, thereafter to be able to case the borehole with commercially available casing of as large a diameter as possible; and, at the same time, be able to retrieve the entire drill string with little danger of becoming stuck downhole. A method which satisfies this desirable drilling operation is the subject of this invention.

SUMMARY OF THE INVENTION

This invention teaches both method and apparatus by which a continuous borehole can be formed horizontally through a pay zone. The borehole extends from an inlet to an outlet formed in the surface of the earth. A casing is cemented within the borehole and extends from the outlet to the inlet, and is perforated along the horizontal portion thereof which extends through the pay zone. Production is achieved by enabling the hydrocarbons to flow from the production formation, into the multiplicity of perforations, whereupon the hydrocarbons are then forced to flow up through one of the marginal ends of the cased borehole, and to the surface of the ground.

The above apparatus for producing hydrocarbons is achieved by the method of the present invention which comprises drilling a borehole in a downward direction and turning the lower end of the borehole so that it extends a considerable length throug a hydrocarbon containing formation, and then turning the borehole back towards the surface of the earth so that ultimately, the drill bit penetrates the surface of the earth at the borehole outlet which is spaced a considerable distance from the borehole inlet. A casing string is progressively made up and attached to the drill string so that as the drill string is pulled back through the borehole, the casing string is placed under tension in proportion to the force required to withdraw the drill string and pull the casing through the already formed borehole. The previously used drilling mud lubricates the sidewall of the borehole to facilitate this operation, and the entire string of casing and drill pipe can be rotated to facilitate the withdrawal of the drill string and the installation of the casing string.

The ends of the casing are prepared in the form of a wellhead so that various manipulations to the borehole can be carried out from either the inlet or the outlet.

In one embodiment of the invention, the casing is perforated prior to being pulled into the borehole, or alternatively, in another embodiment of the invention, the casing is perforated according to my U.S. Pat. No. 4,194,577.

The well is produced through either the inlet or the outlet. In some instances, the well is produced by flowing a fluid into the inlet, thereby forcing produced hydrocarbons and the fluid through the outlet where the produced hydrocarbons are treated and stored.

Accordingly, a primary object of the present invention is the provision of a method of producing hydrocarbons from a highly unconsolidated formation.

Another object of the present invention is the provision of a method of producing extremely viscous hydrocarbons from a sandy production zone located in a downhole formation.

A further object of this invention is the provision of method and apparatus by which a continuous borehole having an inlet spaced from an outlet is formed down into the earth and horizontally a considerable distance through a hydrocarbon containing formation.

A still further object of this invention is the provision of method and apparatus for casing and completing a continuous borehole which has an inlet spaced from an outlet.

Another and still further object of this invention is the provision of a method by which extremely viscous hydrocarbons contained within a very thin and highly unconsolidated formation may be forced to the surface of the earth.

Another object of this invention is the provision of a method wherein a drill string penetrates a strata of the earth to form a continuous borehole which extends from an inlet, vertically downhole and then horizontally through a pay zone, and then vertically uphole to an outlet; a casing string, which is made up as the drill string is withdrawn from the borehole, has one end attached to the free end of the drill string and is pulled through the borehole as the drill string is withdrawn, thereby casing the borehole. The casing is perforated and production is carried out through either the inlet or the outlet.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
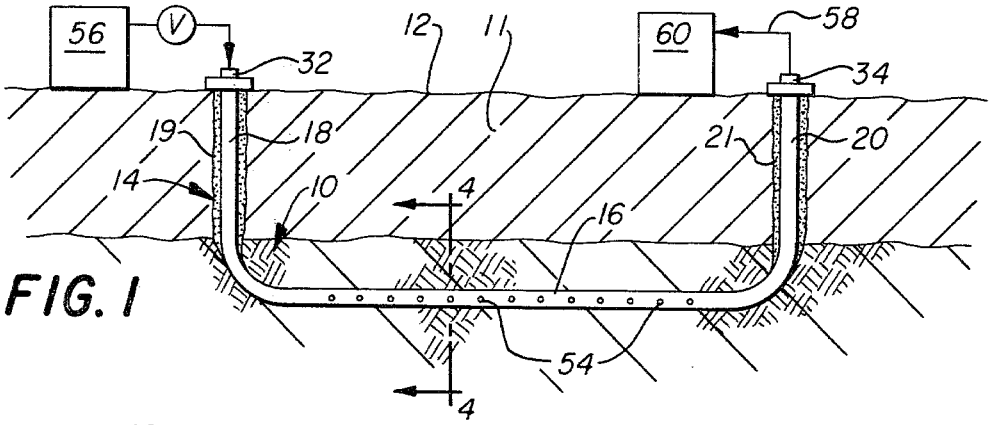
FIG. 1 is a diagrammatical cross-sectional representation of a strata of the earth, having a borehole formed therethrough in accordance with the present invention.
Figure 2:
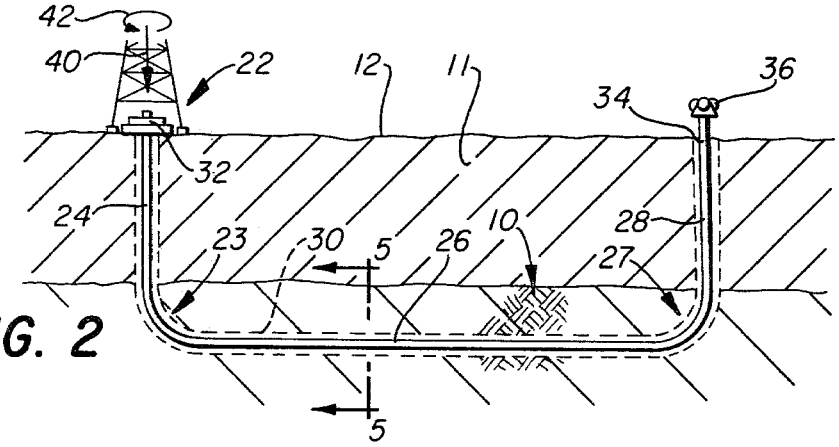
FIG. 2 is similar to FIG. 1 and illustrates part of the method of the present invention.

FIG. 1 illustrates a completed continuous borehole made in accordance with the teachings of the present invention. In FIG. 1, there is diagrammatically illustrated a pay zone 10 which underlies a considerable overburden 11 of the earth. The pay zone may be located several hundred feet below the surface 12 of the ground. A cased borehole 14, made in accordance with this invention, has a horizontal portion 16 which is perforated, and which extends for several thousand feet through the pay zone 10. The cased, continuous borehole therefore downwardly penetrates the earth at 18, turns horizontally through a pay zone 10, and then extends back up towards the surface of the ground at 20.

In other figures of the drawings, a rotary drilling rig 22 turns a drill string 24 which extends downhole. The drill string is curved at 23 so that a horizontal portion 26 extends through the pay zone formation 10. The drill string curves at 27 so that it is turned back uphole at 28, thereby providing a borehole 30 having an inlet 32 and an outlet 34. A drill bit 36 is seen extending above the surface of the ground in attached relationship respective to the free end of the drill string or drill pipe.

The before mentioned casing 16, 18 and 20 is made up of a plurality of joints which are attached to one another in the usual manner. One end portion of the casing is attached at 38 to the free end of the drill string at the location where the drill bit heretofore was attached thereto. This provides a novel means which enables the casing to be pulled back into the borehole as the drilling rig pulls the drill string back through the borehole and towards the drilling rig.

Hence, the drilling rig provides a downward force 40 on the drill string, a rotational force 42 which turns the drill string about its longitudinal centerline, and an upward force 44 which pulls the drill string back towards the rig, so that joints of casing can be made up into the illustrated string of casing 16 as the casing string is pulled into the borehole, thus casing the borehole from the outlet to the inlet.

The casing has a radius of curvature 46 essentially equal to the radius of curvature 23 and 27 of the drill string, or the borehole. The radius of curvature is greatly exaggerated in the drawings, and in actual practice can extend over hundreds of feet, as may be required according to the physical characteristics of the casing.

Figure 3:
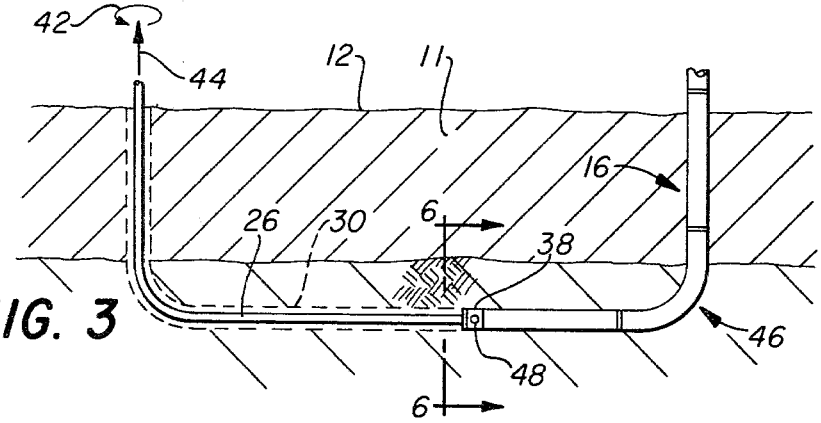
FIG. 3 is similar to FIGS. 1 and 2, and illustrates part of the method of the present invention.
Figure 4:
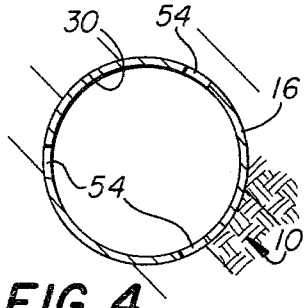
FIGS. 4, 5, and 6, respectively, are enlarged, fragmented, hypothetical views taken along lines 4—4, 5—5, and 6—6, respectively, of FIGS. 1, 2 and 3, respectively.

A circulation port 48 can be formed in proximity of sub 38 for enabling drilling mud to be continuously circulated downhole as the forces 42 and 44 are applied to the drill string and casing, in the manner seen illustrated in FIG. 3, as the casing string is pulled back through the borehole.

Figure 5:
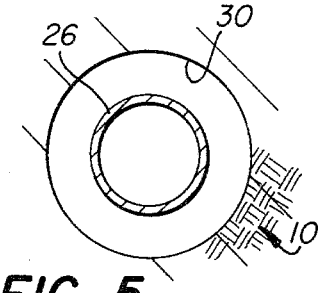
Figure 6:
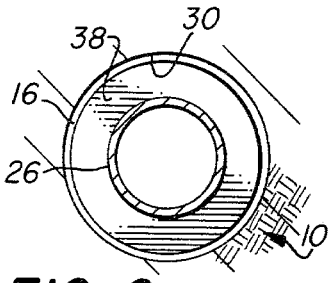

In FIG. 5, an annulus is seen to be formed between the drill string 26 and the borehole wall 30. This area is filled with suitable drilling mud.

After the casing has been pulled back through the borehole and cemented into place, perforations 54 may be formed in accordance with my co-pending U.S. Pat. No. 4,194,577. Alternatively, the casing can be perforated prior to pulling the casing back through the borehole, if the orientation of the perforations 54 are considered to be of no consequence.

Numeral 56 illustrates a supply of working or power fluid used for producing the completed well. The fluid is selected from the following: Nitrogen, $CO_2$, flue gases, air, gaseous hydrocarbons, liquid hydrocarbons, steam, water, and mixtures thereof. The term "fluid" includes gaseous and liquid substances.

Numeral 58 illustrates the return line by which produced fluids and working fluids are flowed into treatment apparatus 60. The treatment apparatus separates water, sand, and debris from the hydrocarbons, and includes any other known treatment apparatus which prepares hydrocarbons for the pipeline or the tank farm.

In the preferred form of the invention, a drilling rig 22 forces a drill string downhole, and at the appropriate elevation the drill bit 36 is turned along a suitable radius at 23 so that a horizontal leg 30 of the borehole is formed within which the drill string at 26 is located. The drill bit again turns about a radius of curvature 27 and continues penetrating in an upward direction until it emerges at outlet 34.

The drill bit is removed from the free end of the drill string so that sub 38 can be substituted therefor. Joints of casing are next attached in series relationship to the sub, so as to progressively make up a casing string. As the casing is pulled into the borehole, the drilling rig turns the drill string, thereby turning the casing string 16, 18 and 20, while low friction drilling mud is pumped through port 48, and tension is placed on the string at 44 so that the casing string is forced from the outlet to the inlet of the borehole as the drill casing string is retrieved.

After the drill string has been retrieved, the inlet and outlet vertical portions 18 and 20 of the cased borehole are cemented into position at 19 and 21, and thereafter several thousand feet of the horizontal portion 16 of the cased borehole are perforated, thereby providing a multiplicity of perforations 54 which extend for perhaps thousands of feet along the horizontal length of the borehole.

This unique arrangement of perforations provides communication with hundreds of square feet of production formation, so that a very small, almost insignificant flow of hydrocarbons through a single perforation when multiplied by the multiplicity of perforations, constitutes a significant production rate.

In some instances, it is possible to produce the well from both boreholes, depending upon the viscosity of the produced hydrocarbons and the amount of sand which flows into the casing. In other instances, it is necessary to produce the well by flowing a suitable fluid from 56, into the inlet 32, so that the hydrocarbons entering the casing through the perforations are forced up the vertical leg 20 of the borehole, through outlet 34, and into the storage tank 60.

Figures 7, 8, 9:
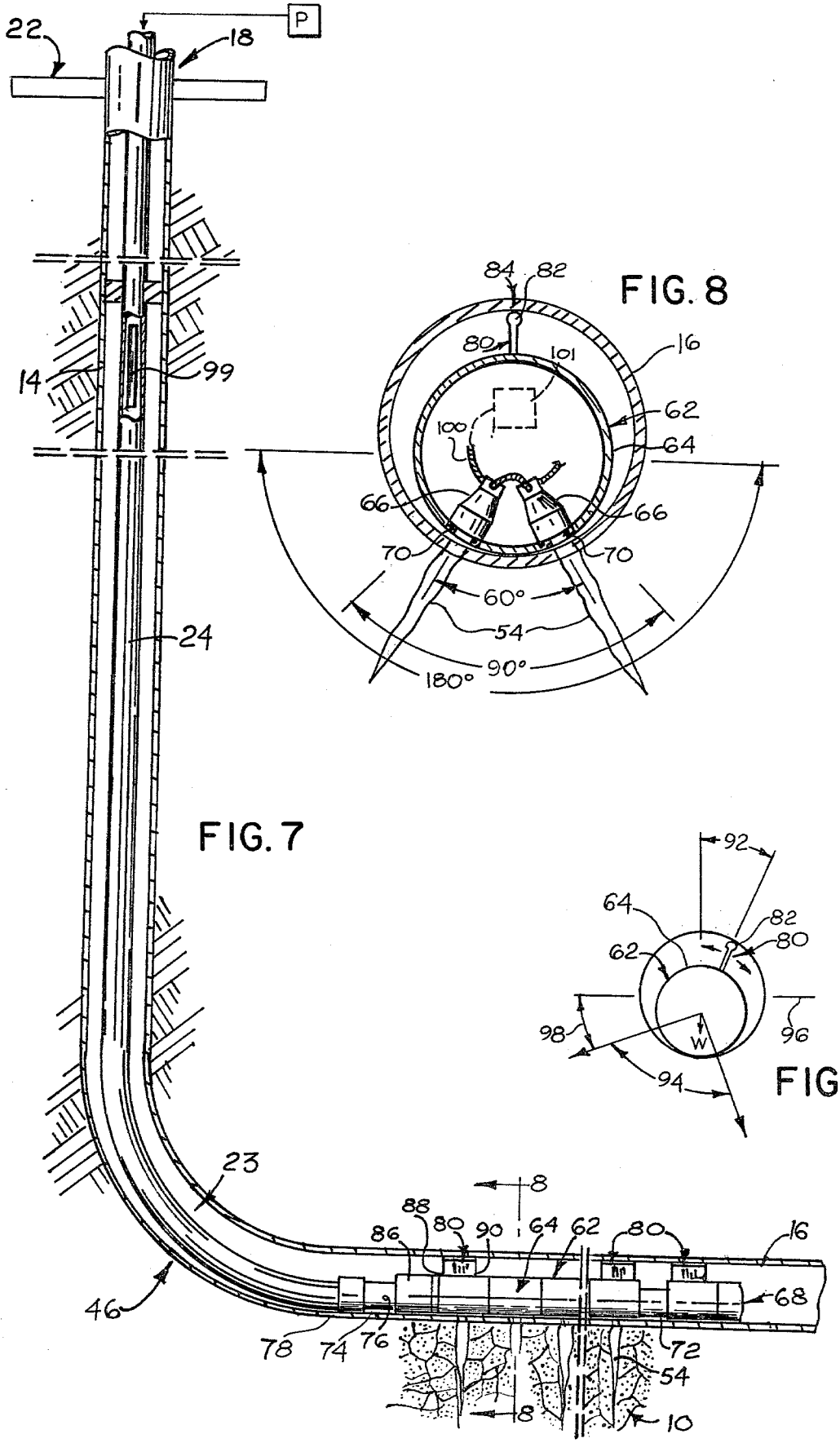
FIG. 7 diagrammatically illustrates a cross-sectional view of a slanted borehole having apparatus made in accordance with the present invention associated therewith.
FIG. 8 is an enlarged, cross-sectional view taken along line 3—3 of FIG. 1, and, FIG. 9 is a diagrammatical cross-sectional view taken along line 8—8 of FIG. 7.

As seen in FIGS. 7, 8, and 9, a jet perforating gun 62, is located downhole in the substantially horizontal portion of the borehole. The gun includes a charge carrier 64 within which there is disposed a plurality of shaped jet perforating explosive-type charges 66. The individual shaped charges are made in accordance with the prior art. A plurality of other charge carriers 68 can be series connected with respect to charge carrier 64. The charge carrier is provided with the usual threaded plugs 70 which form a closure member for a port formed therewithin, through which the hot plasma jet exits to form perforations 54 whenever the gun is detonated.

As specifically seen in FIG. 7, a sub 72 interconnects the charge carriers. Sub 74 is provided with radially spaced apart ports 76 and is connected to the lower end of the drill string 24 by means of swivel means 78. The swivel can take on a number of different forms so long as it provides relatively low friction, axial rotation between the charge carrier and the drill string.

An outwardly directed member 80 is rigidly connected to the outer housing of the charge carrier and preferably extends in opposition to the shaped charges. The outer, free end portion 82 of the member is located in very close proximity to the inside peripheral wall surface 84 of the casing when the gun is in the upright position. The forward end 88 and rear end 90 of the orientating members are preferably curved in order to avoid engagement with any irregularity which may be formed along the casing wall interior.

A gun firing head 86 is affixed to the forward or uphole end of the uppermost charge carrier and is connected in affixed relationship to the ported sub 74.

In FIG. 7, the hydrocarbon bearing formation 10 has been penetrated at 54 by the action of the jet charges. In FIG. 8, the shaped charges have penetrated the plugs to produce a plasma jet of hot gases and vaporized metal which form the tunnels in the manner illustrated.

The operation of the gravity orientating perforating system is illustrated in FIGS. 7, 8, and 9. In particular, FIG. 9 discloses one position respective to the inside wall surface of the casing which may be engaged by the casing engaging member 80 should the gun tend to axially rotate an amount 92 respective to the drill tubing 24 as the gun assembly is run downhole. Should the gun tend to climb the sidewall of the casing, enlargement 82 will be rotated into engagement with the casing wall, thereby preventing any further rotation. At the same time, the mass W of the gun tends to gravitate the gun back into the upright position seen in FIGS. 7 and 8. Numeral 94 illustrates the included angle between the direction of penetration of spaced shaped charges, while numeral 96 illustrates the horizontal plane. The presence of any angle 98 causes the jets to perforate in a downward direction.

In FIG. 7, a weighted object 99, in the form of a sinker bar, is circulated downhole by means of pump P located on drilling platform 22. In FIG. 8, prima cord 100 is illustrated as being looped through each of the apertures located rearwardly within the shaped charges 66 in a conventional manner. Detonating means 101 forms part of the firing head and explodes the prima cord in response to the firing head being contacted or impacted by the sinker bar in accordance with my previously issued U.S. Pat. Nos. 3,706,344 and 4,099,757.

I claim:

1. Method of producing viscous hydrocarbons from a pay zone located in a thin strata, comprising the steps of:

(1) forming a borehole with a drill bit attached to the end of a drill string by extending the borehole down into the ground to form a borehole inlet; and, turning the borehole towards the horizontal to form a horizontal portion borehole which extends through the pay zone; and, turning the borehole up towards the surface of the ground to form a borehole outlet;

(2) attaching a casing string to the end of the drill string at said borehole outlet; pulling the drill string back through the borehole so that the casing string extends from said outlet to said inlet;

(3) removing the end of the drill string from the casing string;

(4) arranging shaped charges within a perforating gun such that said charges, when detonated, are directed in a downward direction radially away from the lower side of the gun;

(5) placing an upwardly extending guide means on said gun in opposition to said shaped charges and extending said guide means away from the gun and into close proximity of the inside peripheral wall of the casing, thereby causing the shaped charges of the gun to gravitate towards the bottom of the horizontal portion of the casing;

(6) running the gun downhole into the horizontal portion of the borehole until the gun is at a location within said pay zone, and firing the gun, thereby forming perforations which extend generally downward through the casing wall and downward and out into the pay zone.

2. Method of producing viscous hydrocarbons from a pay zone located in a thin strata, comprising the steps of:

(1) forming a borehole with a drill bit attached to the end of a drill string by extending the borehole down into the ground to form a borehole inlet; and, turning the borehole towards the horizontal to form a horizontal borehole portion which extends through the pay zone; and, turning the borehole up towards the surface of the ground to form a borehole outlet;

(2) attaching a casing string to the end of the drill string at said borehole outlet; pulling the drill string back through the borehole so that the casing string is pulled into the borehole and extends from said outlet to said inlet;

(3) rotating the casing as it is pulled into the borehole while drilling fluid is circulated down the drill string into the borehole annulus, and back up the borehole annulus;

(4) removing the end of the drill string from the casing string;

(5) arranging shaped charges within a perforating gun such that said charges, when detonated, are directed in a downward direction radially away from the lower side of the gun;

(6) placing a guide means on said gun for causing the gun to be oriented such that the charges, when detonated, are directed towards the bottom of the horizontal casing;

(7) running the gun downhole into the horizontal portion of the casing until the gun is at a location within the pay zone to be completed, and firing the gun, thereby forming perforations which extend generally downward through the casing wall and out into a formation.

3. Method of producing viscous hydrocarbons from a pay zone located in a thin strata, comprising the steps of:

(1) forming a borehole with a drill bit which is attached to the end of a drill string by extending the borehole down into the ground to form a borehole inlet; and, turning the borehole towards the horizontal to form a substantially horizontal borehole portion which extends through the pay zone; and, turning the borehole up towards the surface of the ground to form a borehole outlet;

(2) attaching a casing string to the end of the drill string at said borehole outlet; rotating the casing with the drill string while pulling the drill string back through the borehole so that the casing string extends from said outlet to said inlet; and circulating drilling fluid down through the drill string and into the borehole annulus while the casing is being pulled into the borehole to thereby reduce the frictional forces between the casing and the borehole wall;

(3) removing the end of the drill string from the casing string; forming a multiplicity of flow paths which extend from the pay zone, through the wall of the casing, and into the interior of the casing; and, producing the well through one of said inlet or outlet.

4. The method of claim 3 wherein the casing is perforated after the borehole is cased, according to the following steps:

(1) arranging shaped charges within a perforating gun such that said charges, when detonated, are directed in a downward direction radially away from the lower side of the gun;

(2) providing means on said gun for causing the gun to be oriented such that the charges are directed towards the bottom of the horizontal casing;

(3) running the gun downhole into the horizontal portion thereof until the gun is at a location within the pay zone to be completed, and firing the gun, thereby forming perforations which extend generally downward through the casing wall and downward and out into the pay zone formation.

5. The method of claim 3 wherein the casing is perforated according to the additional following steps:

(4) arranging shaped charges within a perforating gun such that said charges, when detonated, are directed in the same general direction radially away from the one side of the gun;

(5) placing a guide means on said gun in opposition to said shaped charges and extending said guide means away from the gun and into close proximity of the inside peripheral wall of the casing, thereby causing the side of the gun containing the charges to gravitate towards the bottom of the substantially horizontal casing;

(6) running the gun downhole into the substantially horizontal portion of the borehole until the gun is at a location within the pay zone to be completed, and firing the gun, thereby forming perforations which extend generally downward through the casing wall and out into the pay zone.

6. The method of claim 3 and further including the steps of:

(1) flowing a working fluid into said inlet of said casing so that production fluid admixed with the working fluid is forced to said outlet;

(2) selecting said working fluid from the following: nitrogen, $CO_2$, flue gases, water, steam, liquid hydrocarbons, gaseous hydrocarbons, and air.

7. The method of claim 3 wherein the casing is perforated before being introduced into the borehole.

* * * * *